US006463903B1

(12) United States Patent
Berlinger et al.

(10) Patent No.: US 6,463,903 B1
(45) Date of Patent: Oct. 15, 2002

(54) PISTON ASSEMBLY FOR FREE PISTON INTERNAL COMBUSTION ENGINE

(75) Inventors: Willibald G. Berlinger; William E. Moser; Leland W. Weiss, all of Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/943,173

(22) Filed: Aug. 30, 2001

(51) Int. Cl.[7] ..... F02B 71/00
(52) U.S. Cl. ..... 123/193.6; 123/46 R
(58) Field of Search ..... 123/193.6, 46 R, 123/46 A, 46 B, 46 SC, 46 E, 46 H

(56) References Cited

U.S. PATENT DOCUMENTS 4,161,165 A * 7/1979 Belush et al. ..... 123/193.6
6,105,541 A 8/2000 Berlinger ..... 123/46 R
6,152,091 A * 11/2000 Bailey et al. ..... 123/46 R
6,158,401 A * 12/2000 Bailey ..... 123/46 SC
6,269,783 B1 * 8/2001 Bailey ..... 123/46 R
6,314,924 B1 * 11/2001 Berlinger ..... 123/46 R

* cited by examiner

*Primary Examiner*—Marguerite McMahon
(74) *Attorney, Agent, or Firm*—Todd T Taylor

(57) ABSTRACT

A free piston internal combustion engine, particularly suitable for use in a vehicle, is provided with a combustion cylinder and a piston assembly. The piston assembly includes a piston and a plunger shaft. The piston is reciprocally movable within the combustion cylinder. The piston includes a crown, a skirt extending from the crown and having a piston ring groove therein, a hub attached to the plunger shaft, and at least one support block. Each support block is positioned adjacent to the crown and extends from the hub toward the skirt. Each support block, skirt and piston ring groove defines a cut-out there between. The cut-out provides mechanical support to the piston during acceleration, and also provides effective heat transfer for cooling the piston ring groove.

23 Claims, 2 Drawing Sheets

PISTON ASSEMBLY FOR FREE PISTON INTERNAL COMBUSTION ENGINE

TECHNICAL FIELD

The present invention relates to free piston internal combustion engines, and, more particularly, to piston assemblies used in free piston internal combustion engines.

BACKGROUND

Free piston internal combustion engines include one or more pistons which are reciprocally disposed within corresponding combustion cylinders. However, the pistons are not interconnected with each other through the use of a crankshaft. Rather, each piston is typically rigidly connected with a plunger shaft which is used to provide some type of work output. For example, the plunger shaft may be used to provide electrical power output by inducing an electrical current, or fluid power output such as pneumatic or hydraulic power output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger shaft at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center (TDC) position.

Pistons used in free piston internal combustion engines typically include a piston head which is entirely constructed from a metallic material such as aluminum or steel. Metals such as aluminum and steel have a relatively high coefficient of thermal expansion. Thus, during operation of the free piston engine, the metallic piston head expands considerably in the radial direction toward the inside surface of the combustion cylinder. Each piston head used in the free piston engine is thus formed with an outside diameter which provides a considerable radial clearance with the inside surface of the combustion cylinder to accommodate the relatively large radial expansion during operation. To prevent blow-by of combustion products past the piston head during operation, the outside peripheral surface of the piston head is formed with one or more piston ring grooves which receive corresponding piston rings therein. The piston rings allow for radial thermal expansion and contraction of the piston head, while at the same time effectively preventing blow-by of combustion products past the piston head.

A problem with using conventional piston and cylinder arrangements is that suitable fluid cooling channels must be provided within the combustion cylinder to effect the proper cooling of the combustion cylinder and piston head. These cooling fluid channels increase the size and complexity of the engine. Moreover, the sliding interface between the piston and cylinder may not provide adequate cooling of the piston.

An example of a piston used in a free piston internal combustion engine is disclosed in U.S. Pat. No. 6,105,541 (Berlinger), assigned to the assignee of the present invention.

The present invention is directed to overcoming one or more of the problems as set forth above.

SUMMARY OF THE INVENTION

In one aspect of the invention, a free piston internal combustion engine is provided with a combustion cylinder and a piston assembly. The piston assembly includes a piston and a plunger shaft. The piston is reciprocally movable within the combustion cylinder. The piston includes a crown, a skirt extending from the crown and having a piston ring groove therein, a hub attached to the plunger shaft, and at least one support block. Each support block is positioned adjacent to the crown and extends from the hub toward the skirt. Each support block, skirt and piston ring groove defines a cut-out therebetween.

DETAILED DESCRIPTION

Figure 1:
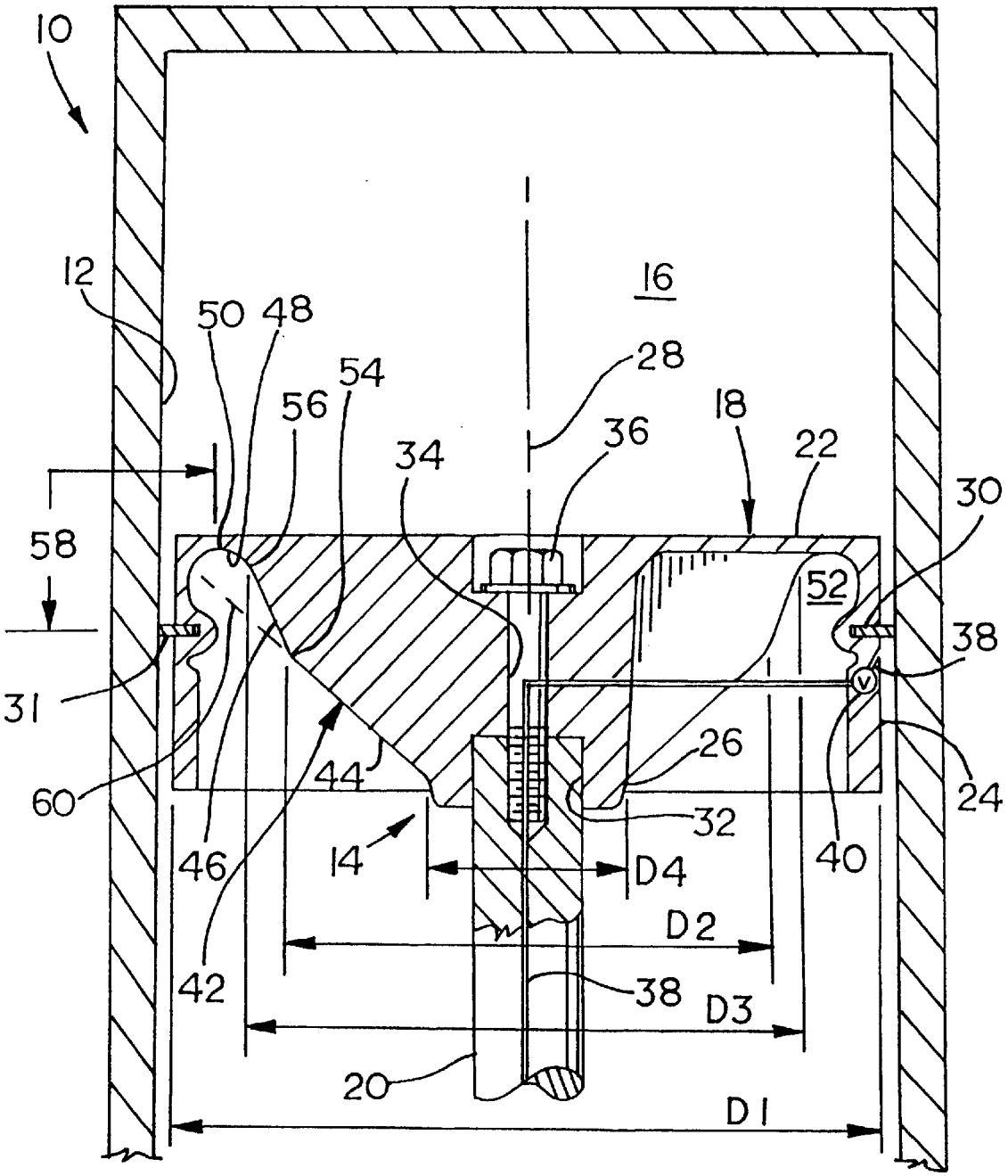
FIG. 1 is a simplified side, sectional view of an embodiment of a free piston internal combustion engine of the present invention.
Figure 2:
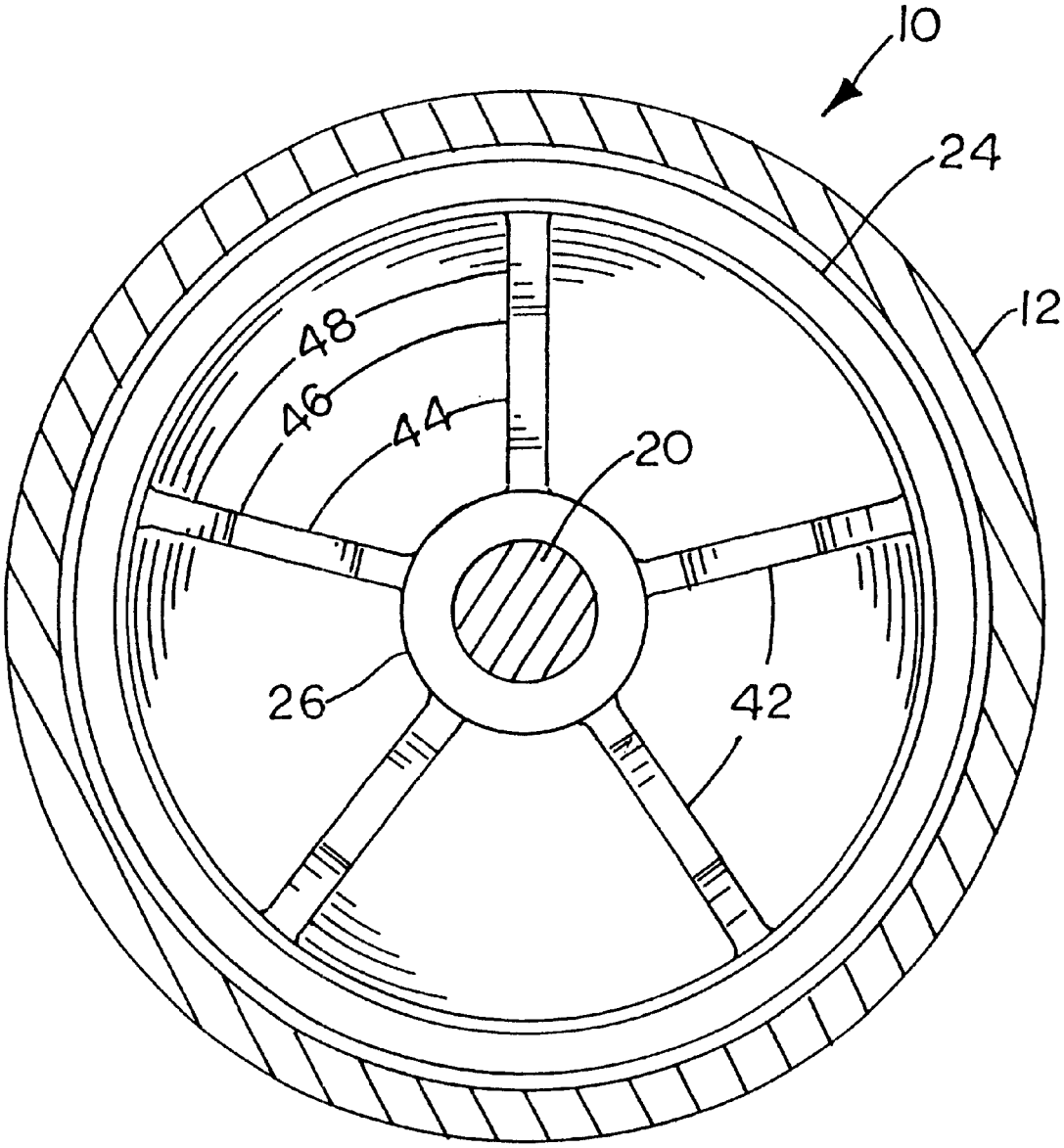
FIG. 2 is an end view of the piston assembly shown in FIG. 1 taken along line 2—2.

Referring now to the drawings, there is shown a portion of an embodiment of a free piston internal combustion engine 10 of the present invention. Free piston internal combustion engine 10 generally includes a combustion cylinder 12 and a piston assembly 14.

Combustion cylinder 12 defines a combustion chamber 16, in which a fuel and air mixture is transported for combustion therewithin. In the embodiment shown, it is assumed that a diesel fuel and air mixture is introduced into combustion chamber 16 for combustion therein. Thus free piston internal combustion engine 10 operates by the diesel principle of operation. Free piston internal combustion engine 10 likely includes a plurality of combustion cylinders 12, however, only a single combustion cylinder 12 is shown in FIG. 1 and described herein for simplicity sake.

Piston assembly 14 generally includes a piston 18 and a plunger shaft 20. Piston 18 includes a crown 22, skirt 24, and hub 26. Crown 22 defines an end face of piston 18 adjacent combustion chamber 16. Crown 22 may be generally planar as shown, or may be contoured to direct exhaust gas in a particular manner within combustion chamber 16.

Skirt 24 defines an annular shaped, peripheral side surface of piston 18. Skirt 24 extends in a longitudinal direction from crown 22 (i.e., generally parallel to longitudinal axis 28 of piston 18. Skirt 24 includes a piston ring groove 30 therein which encircles the entire periphery of skirt 24. Piston ring groove 30 carries a piston ring 31 for inhibiting blow-by of exhaust gas from combustion chamber 16 during operation. A cut-away 64 below piston ring groove 30 provides greater thermal flexibility of piston ring groove 30 when crown 22 and skirt 24 are heated during use. Cut-away 64 thereby helps to avoid piston ring clamping and seizure.

Hub 26 has an opening 32 positioned generally concentrically with longitudinal axis 28. An end of plunger shaft 20 is received within opening 32 for interconnecting piston 18 with plunger shaft 20. Bolt hole 34 receives an externally threaded bolt 36 therein. Bolt 36 couples plunger shaft 20 with piston 18.

Piston 18 also includes an oil lubrication passage 38 in skirt 24. Oil lubrication passage 38 receives lubricating oil, such as hydraulic oil, for lubricating piston ring 31 carried by piston ring groove 30 and the internal side wall of combustion cylinder 12. An acceleration actuated check valve 40 is positioned within oil lubricating passage 38 in skirt 24. Acceleration check valve 40 is opened upon acceleration when piston 18 is at or near a top dead center position within combustion chamber 16 and compression combustion of the fuel and air mixture occurs. The acceleration value at which check valve 40 opens, as well as the amount of flow through check valve 40, may be configured depending upon the particular application.

Plunger shaft 20 includes an end opposite from piston 18 (not shown) which is positioned within a hydraulic cylinder. Plunger shaft 20 pressurizes the hydraulic oil within the hydraulic cylinder during a return stroke of piston assembly 14 to provide pressurized hydraulic oil to a hydraulic load (not shown) such as a hydrostatic transmission or the like. Providing a hydraulic output using a plunger shaft in a free piston engine is known, and thus is not described in further detail herein.

Plunger shaft 20 also includes a portion of oil lubrication passage 38 which terminates adjacent piston ring groove 30. Oil lubrication passage 38 is shown in schematic form in the drawing. It will be appreciated that the particular porting, conduits, etc. in piston assembly 14 which define oil lubrication passage 38 through each of plunger shaft 20 and piston 18 may vary, depending upon the particular application.

Piston 18 also includes at least one support block 42 which is positioned adjacent to crown 22 and extends from hub 26 toward skirt 24. In the embodiment shown, piston 18 includes a plurality of support blocks in the form of vanes 42 which extend radially from hub 26 toward skirt 24. Vane 42 to the left of hub 26 is shown in FIG. 1 in sectioned form, while vane 42 to the right of hub 26 is shown FIG. 1 in non-sectioned form The exact number of vanes 42 spaced equidistantly around hub 26 may vary, depending upon the particular application.

Vanes 42 provide a dual functionality of mechanically supporting piston 18, as well as assisting in cooling of skirt 24 adjacent piston ring groove 30. As will be appreciated, substantial g-forces are applied to piston 18 during acceleration upon combustion within combustion chamber 16. Vanes 42 are configured to provide sufficient structural support to inhibit over flexing of piston 18 which may result in fatigue failure over time. Additionally, vanes 42 are configured to define cut-outs 52 adjacent piston ring groove 30 which channel heat away from piston ring groove 30, thereby providing thermal flexibility and allowing crown 22 to expand under high heat loads.

Each vane 42 includes a first linear portion 44, a second linear portion 46 and a curved portion 48. First linear portion 44 extends from hub 26 at an acute angle relative to longitudinal axis 28. In particular, first linear portion 44 extends toward an area located between piston ring groove 30 and crown 22. Second linear portion 46 is positioned adjacent to first linear portion 44 and extends from first linear portion 44 at an acute angle. Second linear portion 46 also extends at an acute angle relative to longitudinal axis 28 which is smaller than the acute angle of first linear portion 44 relative to longitudinal axis 28. Curved portion 48 is adjacent to and extends from second linear portion 46 toward crown 22. Curve portion 48 terminates at an apex point 50 which is closest to crown 22. Second linear portion 46, curved portion 48 and skirt 24 define annular-shaped cut-out 52 which surrounds the annular periphery of skirt 24.

From the foregoing description of piston 18, including vanes 42, it is apparent that a number of different diameters may be defined which effect the dual functionality of mechanical support and heat transfer of piston 18. These different diameters have been found to be important to provide proper cooling of skirt 24 and piston ring groove 30.

The various transition points between hub 26, first linear portion 44, second linear portion 46 and curved portion 48 define different diameters important to the design of piston 18. Combustion cylinder 12 defines a first diameter corresponding to the bore diameter within which piston 18 reciprocates. The inside diameter of combustion cylinder 12 generally corresponds to the outside diameter of skirt 24, notwithstanding a predetermined clearance distance therebetween.

The juncture between first linear portion 44 and second linear portion 46 defines a juncture point 54 corresponding to a second diameter D2. The ratio of second diameter D2 divided by the first diameter D1 is less than or equal to approximately 0.98.

The transition between second linear portion 46 and curved portion 48 defines a transition point 56, which in turn defines a third diameter D3. A ratio of third diameter D3 divided by first diameter D1 is less than or equal to approximately 0.98.

Hub 26 defines a forth diameter D4 at the outside diameter thereof. The ratio of the fourth diameter D4 divided by first diameter D1 is less than or equal to approximately 0.41.

Moreover, the distance between apex 50 which is closest to crown 22 and piston ring groove 30 has also been found to be an important design criteria. If piston ring groove 30 is too close to crown 22, excessive heat transfer to the area adjacent piston ring groove 30 may occur. On the other hand, if piston ring groove 30 is too far from crown 22, a compression ratio of free piston internal combustion engine 10 decreases which in turn results in decreased efficiency.

Apex point 50 and piston ring groove 30 define a ring band shelf 58 extending there between. This generally corresponds to the distance between the closest point in cut-out 52 to crown 22 and the center of piston ring groove 30. When vanes 42 include curved portion 48 as shown in the drawing, ring band shelf 58 extends both in a longitudinal direction from the center of piston ring groove 30, as well as a radial direction to a location generally perpendicular to apex point 50 along and in contact with the exterior of piston 18 as shown. The ratio of ring band shelf 58 divided by first diameter D1 is less than or equal to approximately 0.146. This ensures a desirable compression ratio within free piston internal combustion engine 10.

It is also possible under certain applications for vanes 42 to include only a linear portion which extends between hub 26 and skirt 24. That is, first linear portion 44 may extend to and attach with skirt 24 at a location between piston ring groove 30 and crown 22, as indicated by dashed line 60. Configured as such, the apex point closest to crown 22 is then along the side of skirt 24. Ring band shelf 58 would then extend from the center of piston ring groove 30 to a location generally perpendicular to the apex point laterally adjacent skirt 24. That is, ring band shelf 58 extends only in a single direction generally parallel to skirt 24, rather than in two directions perpendicular to edge 62.

In the embodiment of piston 18 shown and described above, a plurality of vanes 42 define the support blocks extending from hub 26 toward skirt 24 as described above.

It is also possible, depending upon the particular application, for support block 42 to be configured as a single piece (i.e., an annular-shaped support block surrounding hub 26.) Nonetheless, the different design parameters concerning diameters, etc. described above still apply.

Industrial Applicability

During operation, a diesel fuel and air mixture is injected into combustion chamber 16. Piston assembly 14 travels toward a top dead center position within combustion chamber 16, whereat combustion occurs which drives piston assembly 14 toward a bottom dead center position. During initial acceleration in the return stroke, vanes 42 mechanically support piston 18 to prevent mechanical over flexing. As operation continues, piston 18 becomes hot as a result of repeated combustion with combustion chamber 16. Annular cut-out 52 defined between vanes 42 and skirt 24 in an area between crown 22 and piston ring groove 30 channels heat away from piston ring groove 30 and allows piston ring groove 30 to thermally flex. Also during initial acceleration in the return stroke, acceleration actuated check valve 40 is opened to allow a small amount of lubricating oil to be applied in the space between piston 18 and combustion cylinder 12 adjacent to piston ring 31. This ensures adequate lubrication of piston ring 31, while at the same time applying a very small amount of oil and thereby reducing emissions.

The present invention provides a piston assembly for use in a free piston internal combustion engine which includes a piston having at least one support block positioned longitudinally adjacent to the crown and radially adjacent to the skirt. The at least one support block provides the dual functionality of mechanically supporting the piston during acceleration, and assisting heat transfer of the piston ring groove area within the skirt. By extending each support block in a radial direction from the hub toward the skirt, adequate mechanical support of the piston during operation is provided. Moreover, by providing an annular-shaped cut-out between the piston ring groove and each support block, heat transfer in the area of the piston ring groove is enhanced.

Other aspects, objects and advantages of this invention can be obtained from a study of the drawings, the disclosure and the appended claims.

What is claimed is:

1. A free piston internal combustion engine, comprising:

a combustion cylinder; and a piston assembly including a piston and a plunger shaft, said piston reciprocally movable within said combustion cylinder, said piston including a crown, a skirt extending from said crown and having a piston ring groove therein, a hub attached to said plunger shaft, and at least one sit block, each said support block positioned adjacent said crown and extending from said hub toward said skirt, each said support block, said skirt and said piston ring groove defining a cut-out therebetween.

2. The free piston internal combustion engine of claim 1, each said support block including a first linear portion extending from said hub, a second linear portion adjacent to said first linear portion and extending from said first linear portion at an acute angle, and a curved portion adjacent to and extending from said second linear portion, said first linear portion and said second linear portion defining a juncture point therebetween, said skirt defining a first diameter and said juncture point defining a second diameter, a ratio of said second diameter divided by said first diameter being less than or equal to approximately 0.98.

3. The free piston internal combustion engine of claim 1, each said support block including a first linear portion extending from said hub, a second linear portion adjacent to said first linear portion and extending from said first linear portion at an acute angle, and a curved portion adjacent to and extending from said second linear portion, said second linear portion and said curved portion defining a transition point therebetween, said skirt defining a first diameter and said transition point defining a third diameter, a ratio of said third diameter divided by said first diameter being less than or equal to approximately 0.98.

4. The free piston internal combustion engine of claim 1, each said support block including a first linear portion extending from said hub, a second linear portion adjacent to said first linear portion and extending from said first linear portion at an acute angle, and a curved portion adjacent to and extending from said second linear portion, said skirt defining a first diameter and said hub defining a fourth diameter, a ratio of said fourth diameter divided by said first diameter being less than or equal to approximately 0.41.

5. The free piston internal combustion engine of claim 1, said skirt defining a first diameter, each said support block having one end terminating at said hub and an opposite end terminating at an apex point closest to said crown, said apex point and said piston ring groove having a distance therebetween defining a ring band shelf, a ratio of said ring band shelf divided by said first diameter being less than or equal to approximately 0.146.

6. The free piston internal combustion engine of claim 5, each said support block including a first linear portion extending from said hub, a second linear portion adjacent to said first linear portion and extending from said first linear portion at an acute angle, and a curved portion adjacent to and extending from said second linear portion, said curved portion terminating at said apex point, said ring band shelf extending parallel to said skirt from a center of said piston ring groove to an edge adjacent said crown and also extending from said edge to a center of said apex point.

7. The free piston internal combustion engine of claim 5, each said support block including a linear portion extending between said hub and said skirt, said ring band shelf extending parallel to said skirt from a center of said piston ring groove to said opposite end.

8. The free piston internal combustion engine of claim 1, said piston including at least one oil lubrication passage in fluid communication with said piston ring groove.

9. The free piston internal combustion engine of claim 8, said plunger shaft also including said oil lubrication passage.

10. The free piston internal combustion engine of claim 9, including an acceleration actuated check valve positioned in said oil lubrication passage.

11. The free piston internal combustion engine of claim 1, said at least one support block being a plurality of vanes each radially extending from said hub.

12. A piston assembly for use in a free piston internal combustion engine, comprising:

plunger shaft; and a piston including a crown, a skirt extending from said crown and having a piston ring groove therein, a hub attached to said plunger shaft, and at least one support block, each said support block positioned adjacent said crown and extending from said hub toward said skirt, each said support block, said skirt and said piston ring groove defining a cut-out therebetween.

13. The piston assembly of claim 12, each said support block including a first linear portion extending from said hub, a second linear portion adjacent to said first linear portion and extending from said first linear portion at an acute angle, and a curved portion adjacent to and extending from said second linear portion, said first linear portion and said second linear portion defining a juncture point therebetween, said skirt defining a first diameter and said juncture point defining a second diameter, a ratio of said second diameter divided by said first diameter being less than or equal to approximately 0.98.

14. The piston assembly of claim 12, each said support block including a first linear portion extending from said hub, a second linear portion adjacent to said first linear portion and extending from said first linear portion at an acute angle, and a curved portion adjacent to and extending from said second linear portion, said second linear portion and said curved portion defining a transition point therebetween, said skirt defining a first diameter and said transition point defining a third diameter, a ratio of said third diameter divided by said first diameter being less than or equal to approximately 0.98.

15. The piston assembly of claim 12, each said support block including a first linear portion extending from said hub, a second linear portion adjacent to said first linear portion and extending from said first linear portion at an acute angle, and a curved portion adjacent to and extending from said second linear portion, said skirt defining a first diameter and said hub defining a fourth diameter, a ratio of said fourth diameter divided by said first diameter being less than or equal to approximately 0.41.

16. The piston assembly of claim 12, said skirt defining a first diameter, each said support block having one end terminating at said hub and an opposite end terminating at an apex point closest to said crown, said apex point and said piston ring groove having a distance therebetween defining a ring band shelf, a ratio of said ring band shelf divided by said first diameter being less than or equal to approximately 0.146.

17. The piston assembly of claim 16, each said support block including a first linear portion extending from said hub, a second linear portion adjacent to said first linear portion and extending from said first linear portion at an acute angle, and a curved portion adjacent to and extending from said second linear portion, said curved portion terminating at said apex point, said ring band shelf extending parallel to said skirt from a center of said piston ring groove to an edge adjacent said crown and also extending from said edge to a center of said apex point.

18. The piston assembly of claim 16, each said support block including a linear portion extending between said hub and said skirt, said ring band shelf extending parallel to said skirt from a center of said piston ring groove to said opposite end.

19. The piston assembly of claim 12, said piston including at least one oil lubrication passage in fluid communication with said piston ring groove.

20. The piston assembly of claim 19, said plunger shaft also including said oil lubrication passage.

21. The piston assembly of claim 20, including an acceleration actuated check valve positioned in said oil lubrication passage.

22. The piston assembly of claim 12, said at least one support block being a plurality of vanes each radially extending from said hub.

23. A method of operating a free piston internal combustion engine, comprising the steps of:

providing a combustion cylinder;

providing a piston assembly including a piston and a plunger shaft said piston including a crown, a skirt extending from said crown and having a piston ring groove therein, a hub attached to said plunger shaft, and at least one support block, each said support block positioned adjacent said crown and extending from said hub toward said skirt, each said support block, said skirt and said piston ring groove defining a cut-out there between:

reciprocating said piston within said combustion cylinder; and mechanically supporting said piston and thermally cooling said piston ring groove during said reciprocating step using said at least one support block.

* * * * *

UNITED STATES PATENT AND TRADEMARK OFFICE

CERTIFICATE OF CORRECTION

PATENT NO. : 6,463,903 B1
DATED : October 15, 2002
INVENTOR(S) : Willibald G. Berlinger et al.

It is certified that error appears in the above-identified patent and that said Letters Patent is hereby corrected as shown below:

Column 5,
Line 51, change "sit" to -- support --

Signed and Sealed this

Fourth Day of March, 2003

JAMES E. ROGAN
*Director of the United States Patent and Trademark Office*